US006044781A

United States Patent [19]

Noeltge

[11] Patent Number: 6,044,781

[45] Date of Patent: Apr. 4, 2000

[54] EYELET BUTTONHOLE SEWING MACHINE

[75] Inventor: Thomas Noeltge, Schloss Holte, Germany

[73] Assignee: Dürkopp Adler AG, Germany

[21] Appl. No.: 09/344,929

[22] Filed: Jun. 28, 1999

[30] Foreign Application Priority Data

Jun. 27, 1998 [DE] Germany ..... 198 28 788

[51] Int. Cl.[7] ..... D05B 3/08; D05B 21/00

[52] U.S. Cl. ..... 112/68; 112/73

[58] Field of Search ..... 112/68, 73, 65, 112/66, 70, 447, 475.25

[56] References Cited

U.S. PATENT DOCUMENTS

| | | | |
|---|---|---|---|
| 1,991,627 | 2/1935 | Reece . | |
| 5,752,456 | 5/1998 | Nishizawa | 112/70 |
| 5,873,314 | 2/1999 | Gamano et al. | 112/68 X |

FOREIGN PATENT DOCUMENTS

| | | |
|---|---|---|
| 2154515 | 5/1972 | Germany . |
| 3302385 | 8/1983 | Germany . |
| 4132586 | 4/1992 | Germany . |

*Primary Examiner*—Peter Nerbun

*Attorney, Agent, or Firm*—Ostrolenk, Faber, Gerb & Soffen, LLP

[57] ABSTRACT

A sewing machine with a table (9) driven by two motors (60, 80) in two directions (x, y) and receiving sewing material (36), with sewing implements and with a cutting device (34) for producing, in the sewing material (36), a buttonhole (28) which is provided with an incision (32) and which is delimited by zigzag stitches of a buttonhole bead (26, 27; 26', 27') which run around the incision (32), the incision (32) being produced before or after sewing the zigzag stitches. The sewing implements include a needle bar (4), driven up and down, and oscillating in the horizontal direction to form the zigzag stitches, and a needle (6), which is provided at the lower end of the needle bar (4) and which cooperates with a looper (11) mounted in the baseplate (12). The sewing implements are further driven in rotation by a third motor (13). The sewing machine also includes a control unit (90), which can store various buttonhole shapes and control the other components. The zigzag oscillating range of the needle (6) is permanently set and is constant, and, in order to form the buttonhole bead (26, 27; 26', 27'), the table (9) is driven in oscillation at the same frequency and in either the same direction as the oscillation of the needle (6) or opposite to the direction of oscillation of the needle (6).

11 Claims, 5 Drawing Sheets

EYELET BUTTONHOLE SEWING MACHINE

CROSS-REFERENCE TO RELATED APPLICATIONS

This is related to Ser. No. 09/256,923 (OFGS File P/2165-39), Ser. No. 09/256,853 (OFGS File P/2165-40), and Ser. No. 09/265,034 (OFGS File P/2165-41), the disclosures of which are incorporated by reference.

BACKGROUND OF THE INVENTION

The present invention relates to an eyelet buttonhole sewing machine.

It relates more specifically to an improvement in a sewing machine of a type having a table driven by two motors in two directions and receiving sewing material, having sewing implements, and having a cutting device for producing, in the sewing material, a buttonhole incision. The incision is delimited by zigzag stitches of a buttonhole bead which run around the incision. The incision is produced either before (in the "precutting mode") or after (in the "postcutting mode") the buttonhole bead. The sewing implements comprise a needle bar, driven up and down and oscillating additionally in the horizontal direction, and a needle, which is provided at the lower end of the needle bar and which cooperates with a looper mounted in the baseplate.

In the precutting mode, the sewing material is first incised and the buttonhole bead is then produced around the incision. In the postcutting mode, the buttonhole bead is produced first and then the sewing material is incised. In the postcutting mode, an interspace (cutting space) is formed between the two mutually opposite stitched rows forming the buttonhole bead, so that, when the buttonhole is subsequently cut, only the sewing material is cut, and not the sewn buttonhole bead. In the precutting mode, the mutually opposite stitch rows are formed exactly next to one another, so that the precut cloth is prevented by the stitches from fraying.

A sewing machine of this general type is disclosed, for example, in DE 33 02 385 A1, which is equivalent to U.S. Pat. No. 4,501,207. The motors used are stepper motors, so that this sewing machine can be controlled digitally. By means of a suitable control program, the table movement can be controlled so that different buttonhole shapes can be cut and sewn or embroidered. There is no need for complicated cam mechanisms in order to produce the buttonhole bead in either the precutting or the postcutting mode. In this sewing machine, the sewing implements can be rotated by a third motor. Different buttonhole shapes are stored in a control device, and are correspondingly retrievable therefrom.

U.S. Pat. No. 1,991,627 discloses an eyelet buttonhole sewing machine, in which the needle bar is deflected in the horizontal direction by an oscillating shaft, coupled to the arm shaft via a gear, in order to produce the zigzag stitches.

DE 41 32 586 C2, which is equivalent to U.S. Pat. No. 5,125,349 discloses an eyelet buttonhole sewing machine, in which the intermediate material, which is left within the buttonhole bead in the postcutting mode, is provided by shifting the sewing material in order to produce a so-called offset. This offset is imparted to the transport table, which is driven by two stepper motors arranged in axes (x, y) perpendicular to one another. That is to say, before beginning stitch formation, in order to form one side of the buttonhole bead, the transport table is brought into such a position that the inner needle stitch provided on that side is an appropriate distance from the inner stitch on the opposite side of the buttonhole bead. By the storage of different data records, according to which the stepper motors are controlled, the offset can, depending on the working mode, be provided by a corresponding displacement of the table.

DE 21 54 515 C2 (which is equivalent to U.S. Pat. No. 3,656,443) discloses a sewing machine which can be provided with a special presser foot in order to produce a simple buttonhole. The model for the buttonhole to be sewn is a button of the size for which the buttonhole is to be sewn. The oscillating range of the needle bar can be set according to the desired stitch width, and, in order to produce the buttonhole, the button size is sensed mechanically and the sewing material is guided correspondingly by the special presser foot in a closed curved profile.

All the buttonhole sewing machines described above must have a wide needle hole in the throat plate, designed according to the side-to-side or "swing-out" movement of the needle, so that zigzag stitches can be sewn for forming the buttonhole bead. Due to the wide needle hole, it is, of course, not possible for the needle to be guided accurately while penetrating into the sewing material, so in the above machines the stitch pattern cannot have an optimal appearance.

Moreover, the loop catchers allow only limited stitch widths. Depending on the shape of the desired buttonhole, therefore, different sewing implements (such as a threaded looper, a non-threaded looper and a looper spreader, each associated with a looper and if appropriate also the throat plate) must be installed and adjusted in the sewing machine, thus leading to considerable changeover times. An example of such prior art looper spreaders or spreaders, used to spread a loop of thread to permit entrance of the descending needle, is found in U.S. Pat. No. 2,020,779.

In view of these problems, it is desired to improve the known sewing machine so as to increase the universality of use of the machine. In particular, any desired stitch width should be obtainable, without having to exchange the sewing implements, and, at the same time, unimpaired optimal stitch formation should be achieved.

SUMMARY OF THE INVENTION

In order to solve these problems in an eyelet buttonhole sewing machine, the oscillating range of the needle may be permanently set and constant, and, in order to form the buttonhole bead, the table can be driven in oscillation at the same frequency as the needle and in a direction of oscillation which is either the same as or opposite to the direction of oscillation of the needle.

By virtue of this design, depending on the activation of the motors controlling the table movement in the direction of the X-axis and Y-axis, it is possible to set not only a change in the stitch width, but also a change in the cutting space. If the stitch width is to be reduced, the table moves in the same direction as the needle. If the stitch width is to be increased, the table moves in the direction opposite to the needle movement. As a result of the constant pendulum movement of the needle bar, overall use for sewing is many times simpler and, in sewing terms, more reliable than before. This solution is also considerably less expensive, because the variability of the pendulum movement of the needle bar can be dispensed with. The point where the needle enters into the needle hole is always at the same location with respect to the sewing implements. That is to say, the needle hole can be designed to be correspondingly narrow, even in the case of a large stitch width, so that the needle is accurately guided when it penetrates into the sewing material. This means that sewing implements do not have to be changed when stitch widths of different dimensions are produced.

Even in the case of changing threads having different thread sizes, there is no need for any adjustment. Since, in sewing terms, there are no marginal areas, even when the articulation of the loopers and spreaders is subject to play, the operating reliability of the entire looper system is improved.

Also, the stitch pattern of the buttonhole bead is improved, in that the lower thread can always be cut off and clamped at the same location in the throat plate. The operating reliability of the thread cut-off device is thereby appreciably improved.

Preferably, a data input device is provided, by which the various parameters of a buttonhole can be entered in a control device and, as a function of the entered stitch width, the X- and Y-coordinates to be approached by the table are calculated in a computing unit connected to the control device. It is also advantageous if the X- and Y-coordinates to be approached by the table are calculated as a function of the dimension entered for the cutting space or additionally also for the width of the buttonhole beads.

In this design, all the settings, such as the buttonhole width, cutting space (intermediate cloth) width, and change in cutting space width, can be modified via a keypad of the data input device. Individual corrections of the location where the needle penetrates the sewing material in the region of the eyelet or bar and corrections in the bead width between the outgoing and return bead can also be set. It is particularly advantageous that, by virtue of this design, the intermediate cloth can be modified, if desired, only in regions specially provided, for example in the region of the eyelet or bar.

It is advantageous, for this purpose, if a selector device is provided for operating the sewing machine in the precutting or postcutting mode.

Buttonholes of any conceivable shape can be sewn with the sewing machine according to the invention. Thus, for example, the buttonhole width could be reduced by a predetermined value in terms of stitches, or a flat-drawn bar covering the entire buttonhole width could be provided.

By means of the data input device or the control device, it is possible, in addition to the memories provided for storing the various parameters or the X- and Y-coordinates to be approached, to provide further memories for storing different buttonhole shapes, which may be governed, for example, by the influences of fashion, or for storing the various data for the precutting mode and postcutting mode in special memories.

Other features and advantages of the present invention will become apparent from the following description of embodiments of the invention, with reference to the accompanying-drawings.

DETAILED DESCRIPTION OF EMBODIMENTS OF THE INVENTION

Figure 1:
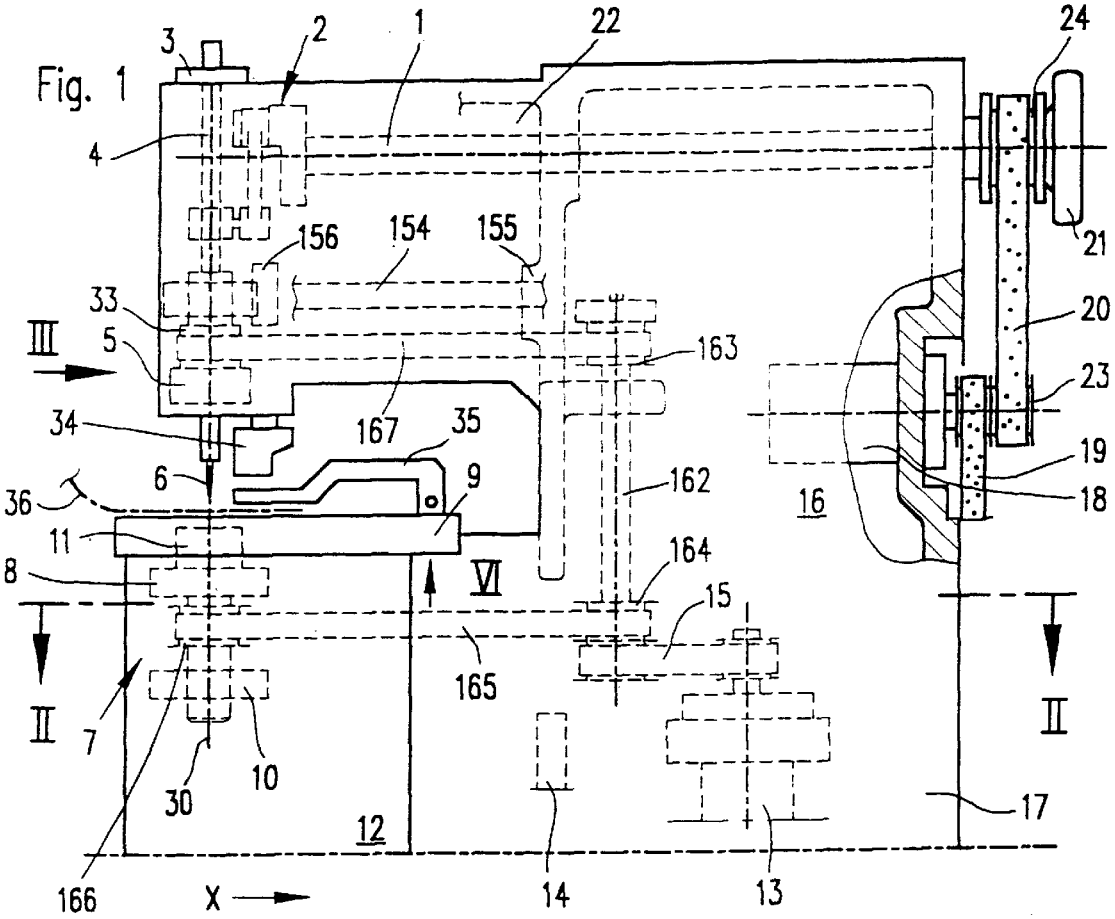
FIG. 1 shows a front view of an eyelet buttonhole sewing machine.
Figure 2:
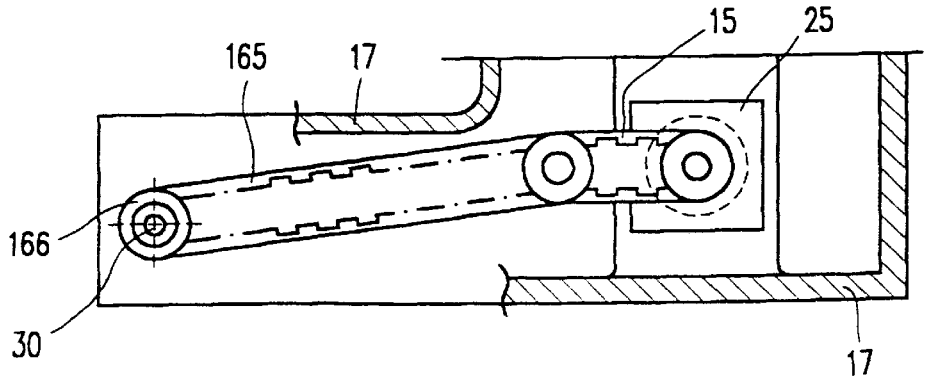
FIG. 2 shows a section along the sectional line II—II according to FIG. 1.

As shown in FIG. 1, the sewing machine has a housing 17 which is composed of the baseplate 12, the column 16 and the arm 22. The arm shaft 1, mounted rotatably in the arm 22, is driven via a motor 18 and a belt drive consisting of two toothed-belt wheels 23, 24 having the toothed belt 20. The arm shaft drives up and down, via a crank mechanism 2, the needle bar 4 mounted vertically in the arm 22 in bearings 3, 5. Inserted into the lower end of the needle bar 4 is the needle 6 which cooperates with the looper 11. The needle bar 4, the needle 6, the looper 11 and the components not illustrated, such as a spreader and a throat plate having a needle hole, form the sewing implements.

A looper bearing 7, which holds the looper 11, is mounted rotatably in an upper bearing 8 and a lower bearing 10. The rotary position of the looper 11 is set by means of the motor 13, which is advantageously a stepper motor, and the toothed belts 15, 165. The sewing implements are coupled to one another via the adjusting shaft 162 having the toothed-belt wheels 163, 164 provided on it, so that the needle bar 4 and the looper 11 can be rotated synchronously about an axis of rotation 30 in order to produce the buttonhole eyelet 28'.

Figure 3:
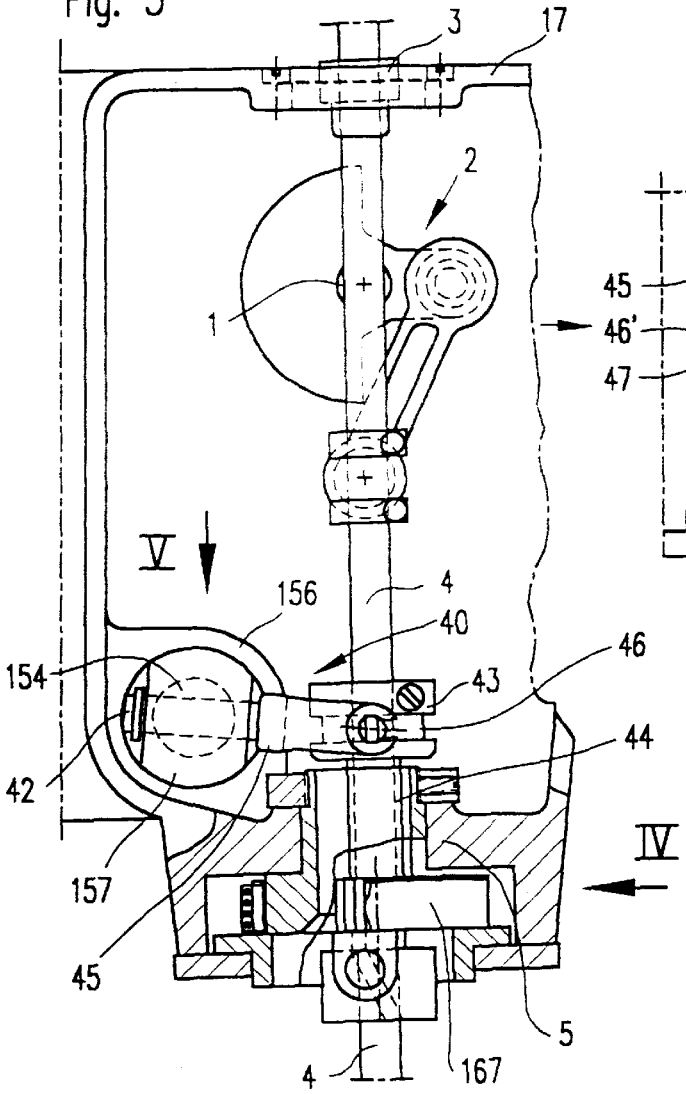
FIG. 3 shows a view in the direction of the viewing arrow III according to FIG. 1.
Figure 4:
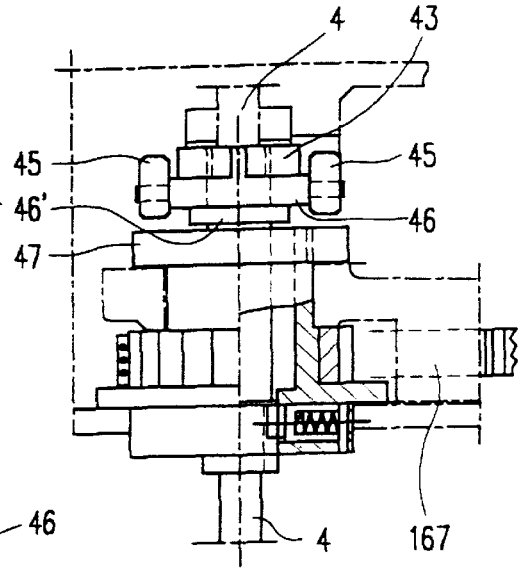
FIG. 4 shows a view in the direction of the viewing arrow IV according to FIG. 3.
Figure 5:
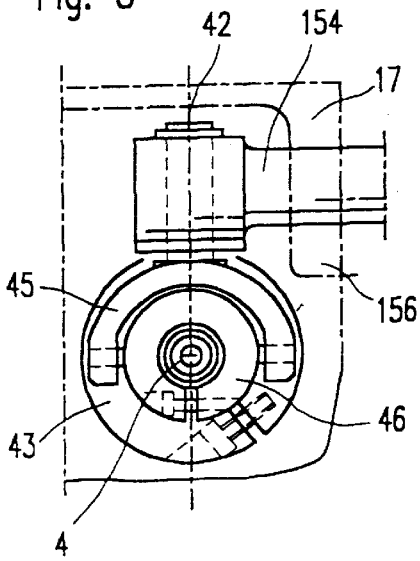
FIG. 5 shows a part view in the direction of the viewing arrow V according to FIG. 3.

The needle bar 4 is oscillated horizontally for producing the zigzag stitches by the needle swing-out mechanism 40 shown in FIG. 3. The oscillating shaft 154 is mounted in a bearing 155 and a bearing 156. A forked lever 45 has a driving ring 46 which rotatably surrounds a driving piece 46'. The driving piece 46' is of tubular design and surrounds the needle bar 4. Moreover, the driving piece 46' is designed with a collar (not designated) which, together with an adjusting ring 43, receives the driving ring 46 rotatably within itself. The forked lever 45 is provided with a journal 42 which projects in the direction pointing away from the needle bar 4. This journal 42 engages into a thick end of the oscillating shaft 154 (cf. FIG. 5). The amplitude of the swinging movement of the needle is permanently set and predetermined as a constant. The oscillating shaft 154 may be mechanically coupled to the arm shaft 1. Alternatively, a separate motor for predetermining the swinging movement of the needle bar 4 may be connected to the oscillating shaft 154.

Figure 6:
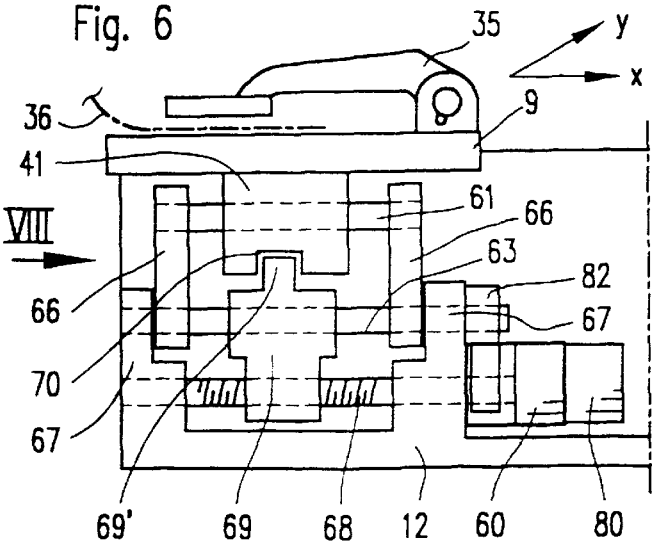
FIG. 6 shows a diagrammatic illustration of the detail, identified by VI, according to FIG. 1.

As shown in FIG. 6, the table 9 is driven by the two stepping motors 60, 80 in the directions of the X- and Y-axes which are perpendicular to one another. The drive in the direction of the X-axis is carried out via the stepping motor 60, and the drive in the direction of the Y-axis via the stepping motor 80. The table 9 is designed with bearings 41 which surround rods 61, 62 displaceably in the direction of the X-axis. The rods 61, 62 are firmly connected, at their free ends, to links 65, 66 which are firmly connected, at their free ends, to rods 63, 64. The rods 63, 64 are received rotatably in bearings 67 of the baseplate 12. The rods 61, 62, 63 and 64 are arranged parallel to one another. The arrangement described forms a parallel link guide which allows the table 9 to be displaced in the direction of the Y-axis. Independently, displacement of the table 9 on the rods 61, 62 in the direction of the X-axis is also made possible.

The stepper motor 60 is drive-connected to a spindle 68 which is mounted rotatably in bearings of the baseplate 12. Received on the spindle 68 is a nut 69 which has a driver 69'. The driver 69' engages into a groove 70 which is formed in the bearing 41 received on the rod 61.

The stepper motor 80 arranged parallel to the stepper motor 60 drives a gearwheel 81 which meshes with a toothed segment 82 fastened on the rod 64. A rotational movement of the gearwheel 81 causes a pivoting movement of the link 65 and, consequently, a movement of the table 9 in the direction of the Y-axis.

In this arrangement, the movement of the table 9 is on an arcuate path. However, since the movement in the direction of the Y-axis amounts to only about 3 mm, the accompanying vertical movement of the table 9 in the direction of the needle 6 can be ignored.

Rotational movement of the spindle 68 causes the nut 69 to be displaced in one direction or the other along the X-axis as a function of the direction of rotation. The driver 69' on the nut 69 engages the groove 70 and thereby displaces the table 9 along the rods 61, 62 in the direction of the X-axis.

Figure 7:
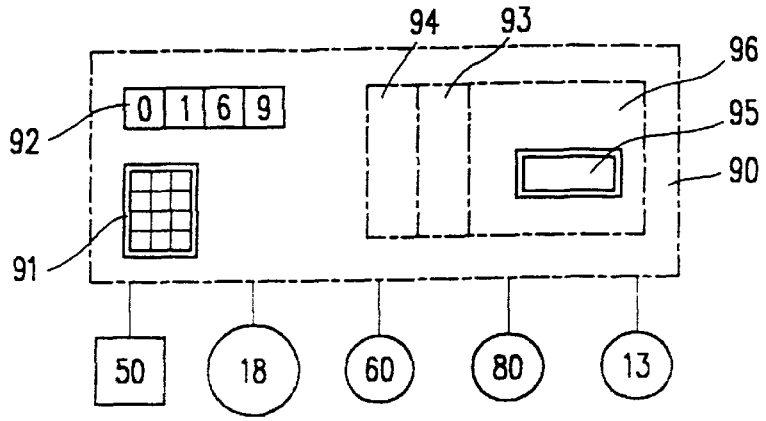
FIG. 7 shows a diagrammatic illustration of a control unit for controlling the various components of the sewing machine.
Figure 8:
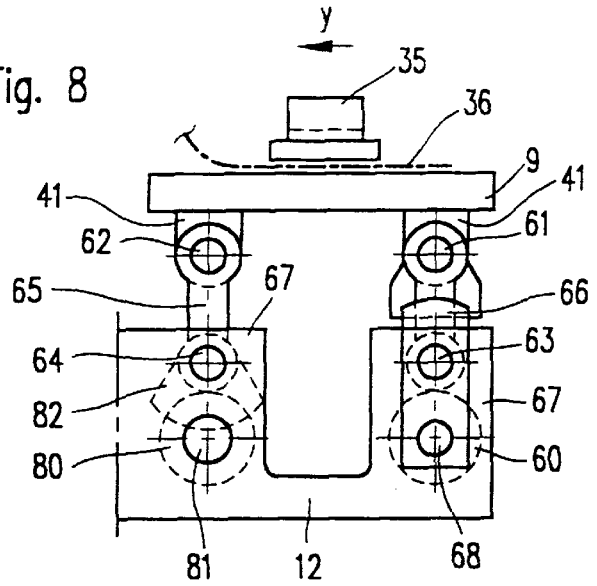
FIG. 8 shows a view in the direction of the viewing arrow VIII according to FIG. 6.
Figure 11:
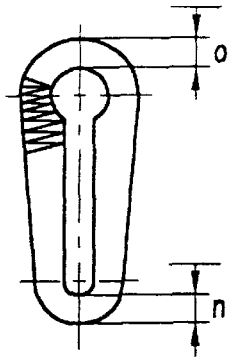
FIG. 11 shows a view of a modified eyelet buttonhole.
Figure 9:
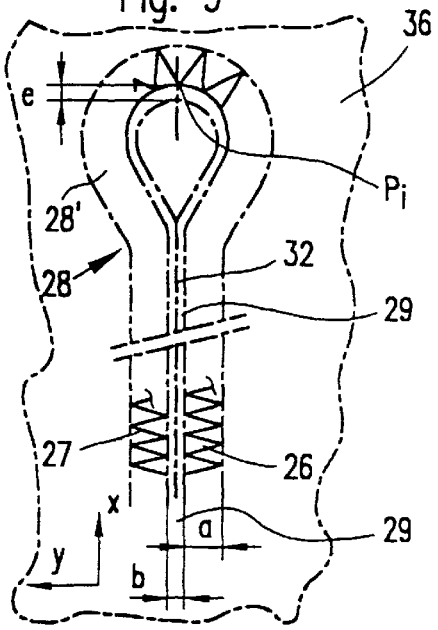
FIG. 9 shows a view of an eyelet buttonhole produced in the postcutting mode, on an enlarged scale.
Figure 10:
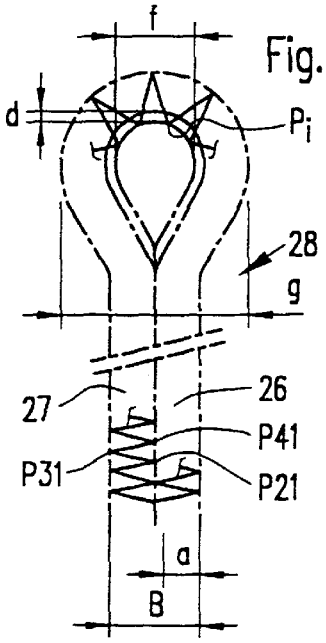
FIG. 10 shows a view of an eyelet buttonhole produced in the precutting mode, on an enlarged scale.
Figure 12:
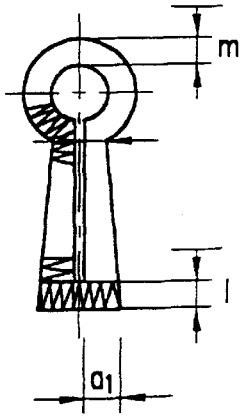
FIG. 12 shows a view of another modified eyelet buttonhole.
Figure 13:
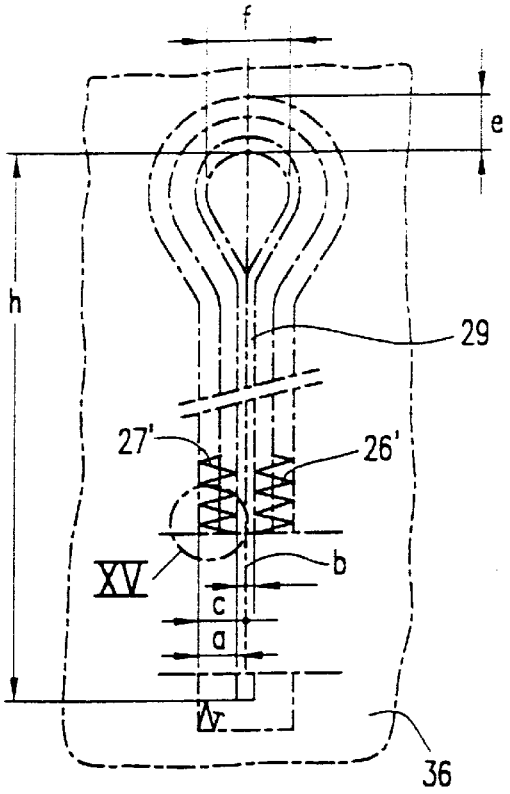
FIG. 13 shows a diagrammatic illustration of the various parameters of a buttonhole.
Figure 14:
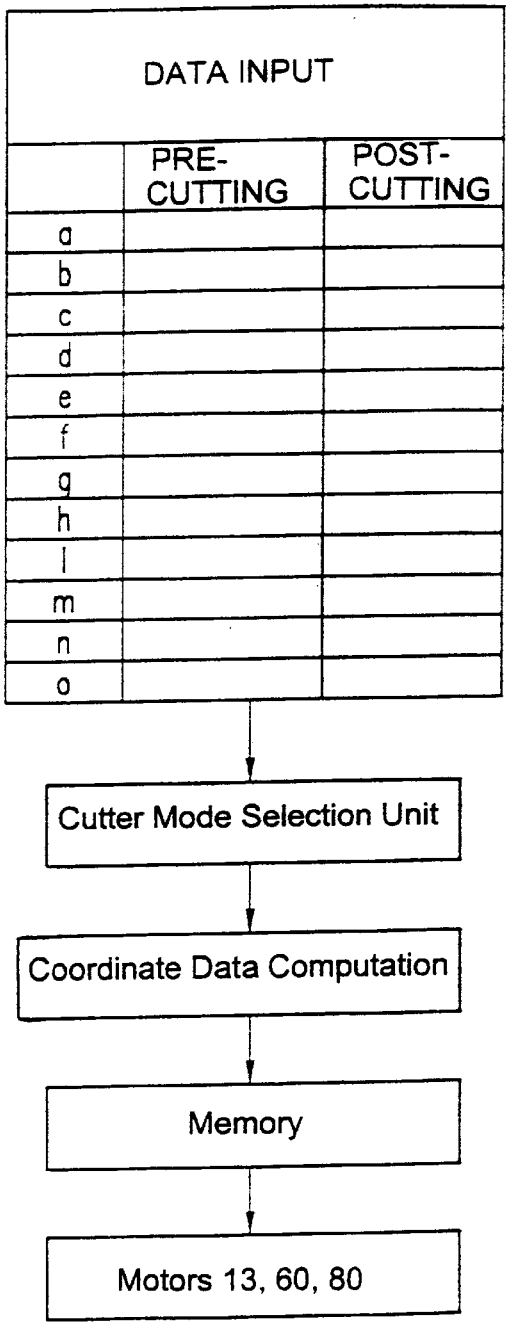
FIG. 14 shows a flow chart for data input and the control of the motors.

FIG. 7 shows the control unit 90 of the sewing machine purely diagrammatically. The various parameters of an eyelet buttonhole 28 (shown as a to o in FIG. 14) can be entered via a keypad 91 and reproduced on the display 92. The parameters of the eyelet buttonhole 28 which are to be entered can be described with reference to FIGS. 9 to 13. The stitch width a is defined as the width, produced on the ready-sewn buttonhole, of a bead 26 or 27 and has a critical influence on the appearance of the buttonhole. The incision 32 has a definable length h. The inner needle pricking points P are fixed in the buttonhole eyelet 28'.

Thus, in the precutting mode (FIG. 10), the distance f, the inner needle pricking points $P_i$ in the direction of the Y-axis and the shifting d from the needle prick inward to the incision having length h are entered. The same applies to the width 1 of a crossbar or the variably modifiable stitch widths m, n, o.

In the postcutting mode (FIGS. 9 and 13), the control unit is given the distance b/2 determining the cutting space 29, that is to say the shifting of the inner needle prick in the direction of the Y-axis for the straight portion of the bead 26', 27'; the distance g which describes the maximum distance between the mutually opposite inner needle pricks in the buttonhole eyelet 28', as well as the dimension e which defines the shifting of the inner needle pricking point $P_i$ in the direction of the X-axis prolonging the cut length h.

On the basis of the data entered, the pricking data (coordinates) are calculated inside the control unit 90 in the computer unit 50 and are stored in a memory 93. Two or more memories 93, 94 may be provided, in which case the first memory 93 may be provided for the data in the precutting mode and the second memory 94 may be provided for the data in the postcutting mode. The control unit 90 may be provided with a floppy disk drive 95, via which various sewing patterns stored on floppy disks can be read into the main memory 96. Via a selector device, the operator can change the sewing machine from the precutting mode to the postcutting mode, or vice versa. The control data for the needle pricking points $P_{ix}/P_{iy}$ are then read out from the memory 93 and serve for activating the stepper motors 60, 80.

With this arrangement, the stepper motors 60 and 80 cause the oscillating movement of the table 9 in the direction of oscillation of the needle 6 and in time with the latter. In special cases when the direction of oscillation of the needle 6 is in the direction of only the X- or Y-axis, the stepper motor 60 or the stepper motor 80 alone causes the oscillating movement of the table 9.

The data contained in the main memory 96 serve for controlling the main drive motor 18, the stepper motors 60, 80 for driving the table 9, and the motor 13 for changing the rotary position of the sewing implements.

The operation of the sewing machine will be explained briefly below:

As already mentioned, the stitch width a is first predetermined, as a consequence of design, by the amplitude for the zigzag movement of the needle bar 4 and is limited by the dimension of the needle hole, the needle swing-out mechanism 40 and the loop catching ability of the looper 11 and the spreader.

It is assumed, in the following description of the production of buttonholes in various designs, that the table 9 basically executes an advancing movement in the direction of the X-axis. In addition to this, and simultaneously, a movement of the table 9 takes place in the direction of the Y-axis. The buttonholes 28 are designed mirror-symmetrically about the line 32.

Figure 15:
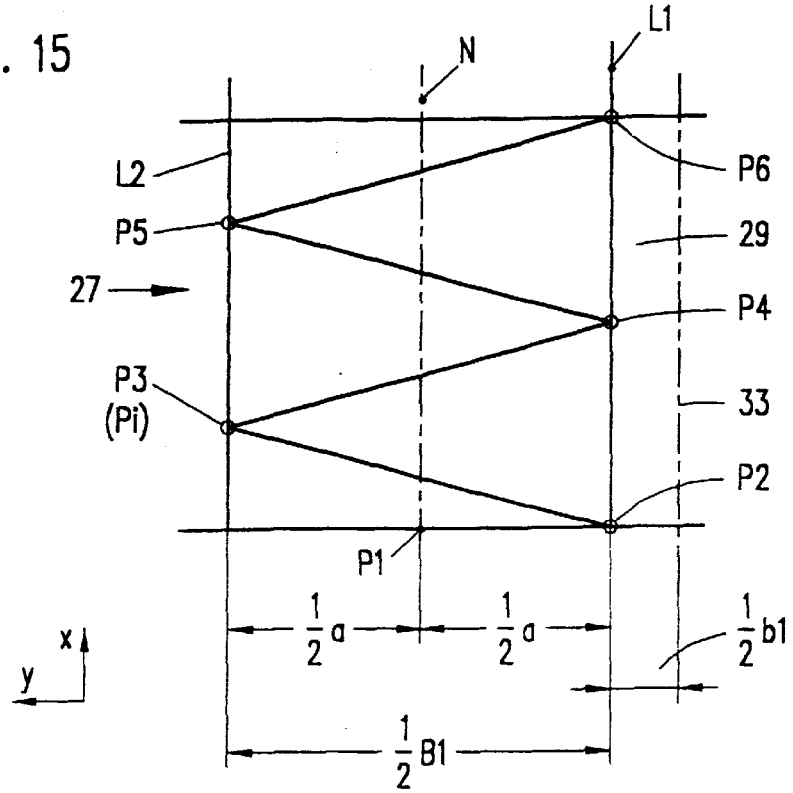
FIG. 15 shows a view of a detail corresponding to the extract XV in FIG. 13, on a further-enlarged scale.

It can be seen from FIG. 15 that the zigzag stitch is produced with a stitch width al a to make the bead 27. In this case, the motor 60 executes a movement and thereby causes the table 9 to be displaced in the direction of the X-axis, while the stepper motor 80 is at a standstill. The table 9 is thus moved on a straight line N. The axis of rotation 30 of the sewing implements is perpendicular to the straight line N.

When the bead 27 is produced in this way, a thread extends from a point P2 via points P3, P4, P5 to a point P6, the points P2, P4 and P6 lying on a line L1 and the points P3 and P5 on a line L2. The width al of the bead 27 corresponds to the distance between the individual points mentioned (designated in general as Pi) in the direction of the Y-axis. Under the conditions mentioned, therefore, the bead 27 is produced at a distance ½ (b1) from the center line 33 corresponding to the incision 32 and with the stitch width al. The distance b1 indicates the width of the cutting space 29 in the direction of the Y-axis.

In order to change the position of the zigzag stitches in respect of the middle position N of the needle 6, the table 9 is moved dynamically, in that the displacement of the table 9 from the needle pricking point $P_i$ to the needle pricking point $P_{i+1}$ takes place. As a result of the dynamic table movement in the direction of the oscillating movement of the needle 6, predetermined by the needle swing-out mechanism 40, the oscillating movements of the table and of the needle are superposed in such a way that zigzag stitches with changed stitch widths a and stitch positions can be produced. The table 9 is therefore driven in oscillation, in the manner of a shaking grate, at the same frequency as the needle bar 4.

Figure 16:
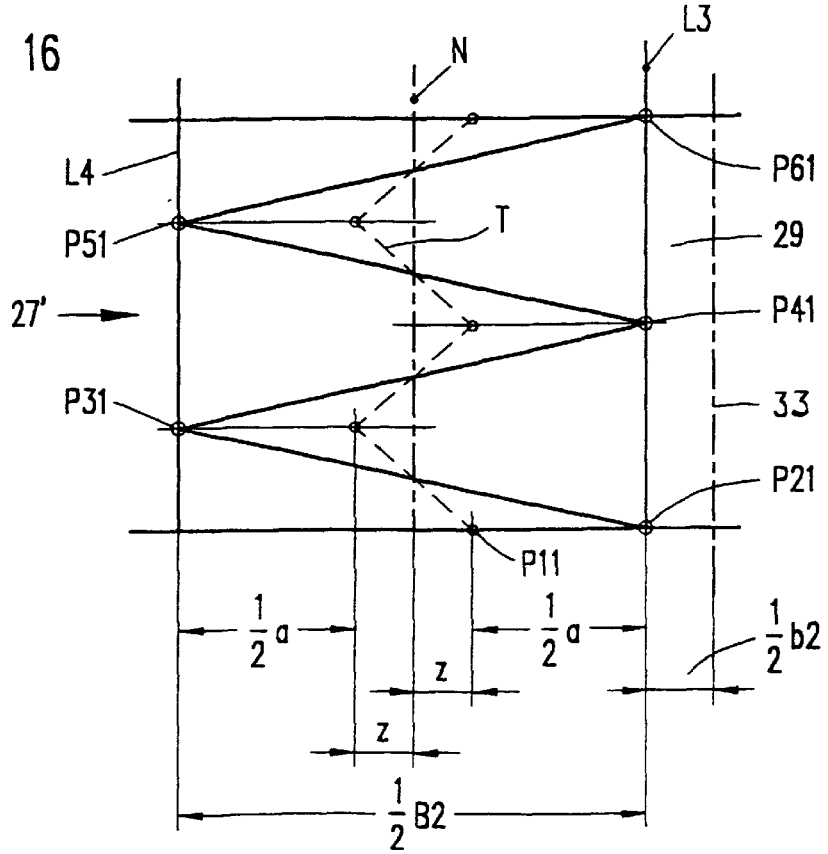
FIG. 16 shows a view corresponding to that of FIG. 15, with a modified stitch arrangement.

In the illustration of the bead 27', shown in FIG. 16, it may be assumed that the table 9 executes a compensating movement, in which the table 9 therefore executes, on both sides of the line N, a movement having the dimension z in the direction of the Y-axis. The compensating movement of the table 9 takes place correspondingly along a zigzag-shaped line T illustrated by dashes. The compensating movement of the table 9 is achieved by the additional activation of the stepper motor 80 simultaneously with the activation of the stepping motor 60. The table 9 therefore moves, with respect to the line N, in a similar way to a shaking grate, in time with the pricks of the needle 6 at the points P21, P31, P41, P51, P61 of the sewing material 36.

Depending on the activation of the stepper motors 60, 80 controlling the movement of the table 9 and, in particular, the compensating movement, a modification of the overall width B2 and/or of the cutting space 29 can be achieved, while the amplitude of the zigzag movement of the needle 6 remains unchanged.

FIG. 16 makes clear the mathematical relationship of the various parameters B2, a2, z and b2, which results in the following formula:

$$B2=2\cdot(2\cdot\tfrac{1}{2}\cdot a2+2z+\tfrac{1}{2}\cdot b2)=2\cdot a2+4\cdot z+b2.$$

When generalized, this yields $$B=2\cdot a+4\cdot z+b,$$

from which follows $$z=\tfrac{1}{4}\cdot(B-2\cdot a-b).$$

In an actual sewing machine, the needle 6 executes the constant zigzag movement, by means of which a dimension a=2.75 mm of the bead 26 or 27 of the zigzag stitches is produced. In practice, however, buttonholes with beads having the dimension a=2 to 3.5 mm may be required. The compensating movement of the table 9 is calculated from the following calculation examples as follows:

EXAMPLE 1: (FIG. 15)

a=2.75 B=6.5 b=1.0 z=?

$$z=\tfrac{1}{4}\cdot(B-2\cdot a-b)=\tfrac{1}{4}\cdot(6\cdot5-2\cdot2.75-1.0)=0$$

The production of a buttonhole 28 is thus carried out, in which the table 9 does not execute any compensating movement in the direction of the Y-axis from pricking point to pricking point when the beads 26' or 27' are being made.

EXAMPLE 2: (FIG. 16)

a=2.75 B=7.0 b=3.0 z=?

$$z=\tfrac{1}{4}\cdot(B-2\cdot a-b)=\tfrac{1}{4}\cdot(7.0-2\cdot2.75-0.3)=0.3$$

The production of a buttonhole 28 is thus carried out, in which the table 9 executes a compensating movement in the direction of the Y-axis from pricking point to pricking point when the beads 26 or 27 are being made. The compensating movement takes place in such a way that the table 9 is moved in the positive direction of the Y-axis, for example for making the point P21, and in the negative direction of the Y-axis for making the point P31.

As is evident from the formula $z=\tfrac{1}{4}\cdot(B-2\cdot a-b)$, the invention makes it possible, by means of a compensating movement of the table 9 taking place from point to point (each point being a location of the prick of the needle 6), to exert influence on the width B and/or on the distance b as a dimension for the cutting space 29.

Although the present invention has been described in relation to particular embodiments thereof, many other variations and modifications and other uses will become apparent to those skilled in the art. Therefore, the present invention is not limited by the specific disclosure herein.

What is claimed is:

1. A sewing machine comprising:

a table for receiving sewing material, said table being drivable in two directions (x, y);

a needle bar driven up and down for piercing the sewing material and oscillating horizontally for producing zigzag stitches, and a needle, which is provided at the lower end of the needle bar and which cooperates with a looper mounted in the sewing machine; and a cutting device for producing, in the sewing material, an incision of a buttonhole, said incision being delimited by zigzag stitches of a buttonhole bead which run around the incision, the incision being produced either before or after sewing;

wherein the needle oscillates over a constant horizontal range, and, in order to form the buttonhole bead, the table is driven in oscillation at the same frequency either in the direction of oscillation of the needle or opposite to the direction of oscillation of the needle.

2. The sewing machine as claimed in claim 1, further comprising a control system which receives a desired stitch width of a buttonhole and as a function of said stitch width, calculates X- and Y-coordinates to be approached by the table.

3. The sewing machine as claimed in claim 2, wherein said table is driven in the direction of oscillation of the needle bar, whereby said stitch width is a function of a sum of the respective oscillation movements of the needle bar and the table.

4. The sewing machine as claimed in claim 2, wherein said table is driven in the direction opposite to the direction of oscillation of the needle bar, whereby said stitch width is a function of a difference of the respective oscillation movements of the needle bar and the table.

5. The sewing machine as claimed in claim 2, wherein said control system further receives a dimension of a cutting space to be provided within the buttonhole bead, and calculates the X- and Y-coordinates to be approached by the table as a function of the dimension entered for the cutting space.

6. The sewing machine as claimed in claim 5, wherein the X- and Y-coordinates to be approached by the table are calculated further as a function of a desired overall width of the buttonhole bead.

7. The sewing machine as claimed in claim 2, wherein the X- and Y-coordinates to be approached by the table are calculated further as a function of a desired overall width of the buttonhole bead.

8. The sewing machine as claimed in claim 1, wherein the control system comprises a selector device for determining whether the sewing machine operates in the precutting or postcutting mode.

9. The sewing machine as claimed in claim 8, wherein said control system further receives a dimension of a cutting space to be provided within the buttonhole bead, and calculates the X- and Y-coordinates to be approached by the table as a function of the dimension entered for the cutting space.

10. The sewing machine as claimed in claim 9, wherein the X- and Y-coordinates to be approached by the table are calculated further as a function of a desired overall width of the buttonhole bead.

11. The sewing machine as claimed in claim 8, wherein the X- and Y-coordinates to be approached by the table are calculated further as a function of a desired overall width of the buttonhole bead.

* * * * *